United States Patent [19]

Toohey

[11] Patent Number: 4,616,563

[45] Date of Patent: Oct. 14, 1986

[54] GRILLE CONTROL

[75] Inventor: Kevin I. Toohey, St. Marys, Australia

[73] Assignee: F.F. Seeley Nominees Pty. Ltd., Australia

[21] Appl. No.: 746,396

[22] Filed: Jun. 19, 1985

[30] Foreign Application Priority Data

Jun. 26, 1984 [AU] Australia ..... PG5688

[51] Int. Cl.[4] ..... F24F 13/10

[52] U.S. Cl. ..... 98/40.3; 98/40.24

[58] Field of Search ..... 98/40.3, 94.2, 121.2, 98/40 V, 40 VM, 94 AC, 121 A, 40.24

[56] References Cited

U.S. PATENT DOCUMENTS 4,350,472 9/1982 Morimoto ..... 98/121.2

*Primary Examiner*—Larry I. Schwartz

*Attorney, Agent, or Firm*—Baker, Maxham & Jester

[57] ABSTRACT

A plurality of projections outstanding from an annular ring carrying the blades of the rotatable grille, and a slider bar which is guided for movement by guide means on the frame which carries the air deflector grille, the slider bar having on it at least one abutment surface which can be moved into or out of the path of travel of the projections, and so arranged that upon movement into that path of travel, the abutment surface abuts a projection and thereby inhibits further rotation of the grille.

4 Claims, 4 Drawing Figures

GRILLE CONTROL

This invention relates to control means for arresting the rotation of an otherwise freely rotatable grille in front of a fan.

BACKGROUND OF THE INVENTION

Because an axial flow fan is usually very directional, it is frequently associated with a rotating grille having blades or louvers thereon which divert the airflow issuing from the fan and thereby sweep a large area. However there is sometimes a need for the grille to be capable of being prevented from rotation, either with the blades arranged one above the other, or with them orientated at some angle so that the airflow from the fan can be deflected in a selected direction.

BRIEF SUMMARY OF THE INVENTION

With the object of providing means which can either (a) arrest rotation so that the blades or louvers of a rotary grille are in one position which will match the blades or louvers of the rest of the grille, or (b) arrest rotation of the rotary grille at a selected position so that air issuing from the grille is directed where required, one embodiment of this invention comprises a plurality of projections outstanding from an annular ring carrying the blades of the rotatable grille, and a slider bar which is guided for movement by guide means on the frame which carries the air deflector grille, the slider bar having on it at least one abutment surface which can be moved into or out of the path of travel of the projections, and so arranged that upon movement into that path of travel, the abutment surface abuts a projection and thereby inhibits further rotation of the grille.

With this arrangement, a very inexpensive slider can be utilised which can have one or more abutment surfaces thereon, to be selectively engagable either with anyone of a plurality of circumferentially spaced projections, with a single major projection, or to be out of register therebetween so that the grille is free to fully rotate.

More specifically, the invention consists of a control means for arresting rotation of an air deflector grille which is carried for rotation in a frame, wherein the said air deflector grille has a plurality of air deflector blades carried at their ends in an annular ring, comprising at least one projection outstanding from the annular ring, guide means on the frame, a slider bar guided for movement by the guide means, at least one abutment surface on the slider bar which is movable into or out of the path of travel of each said projection, but, upon movement into that path of travel, the abutment surface abuts a said projection and thereby inhibits the said rotation.

BRIEF DESCRIPTION OF THE DRAWINGS

An embodiment of the invention is described hereunder in some detail with reference to and is illustrated in the accompanying drawings.

Figure 1:
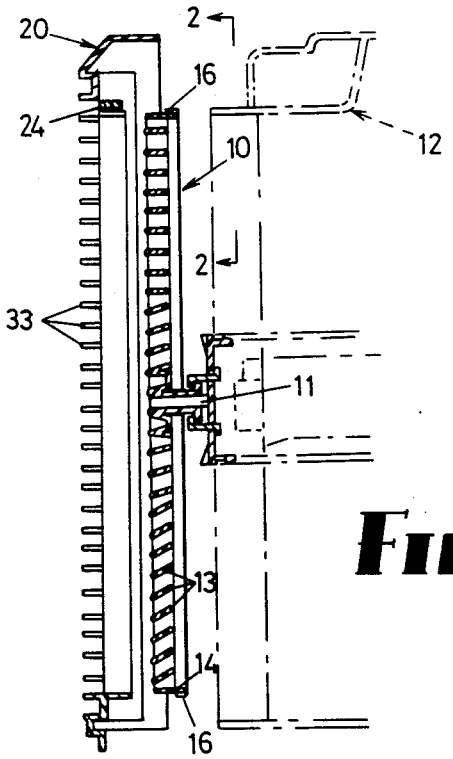
FIG. 1 is a central elevational section through a rotary grille in an air cooler, FIG. 1 however showing the front grille portion of a cooler frame "exploded" away from the remainder of the frame.
Figure 2:
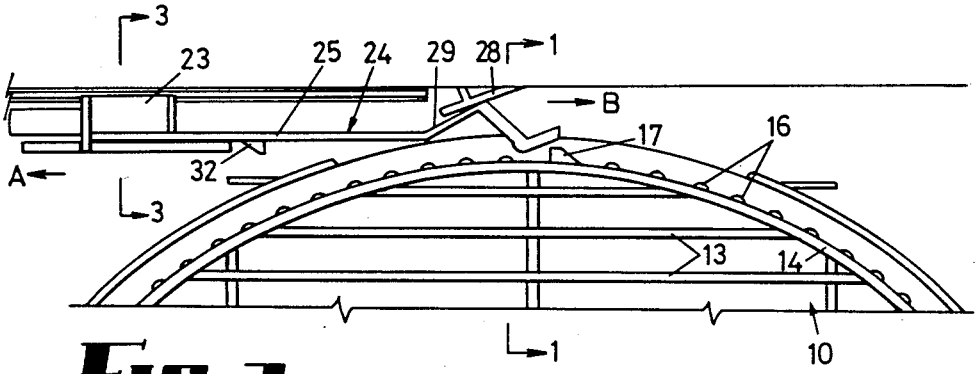
FIG. 2 is a fragmentary end elevation taken on line 2—2 of FIG. 1, FIG. 2 also showing the section line 1—1 which corresponds to the section of FIG. 1.
Figure 3:
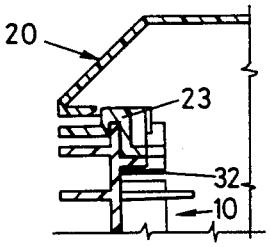
FIG. 3 is a fragmentary section taken on line 3—3 of FIG. 2.
Figure 4:
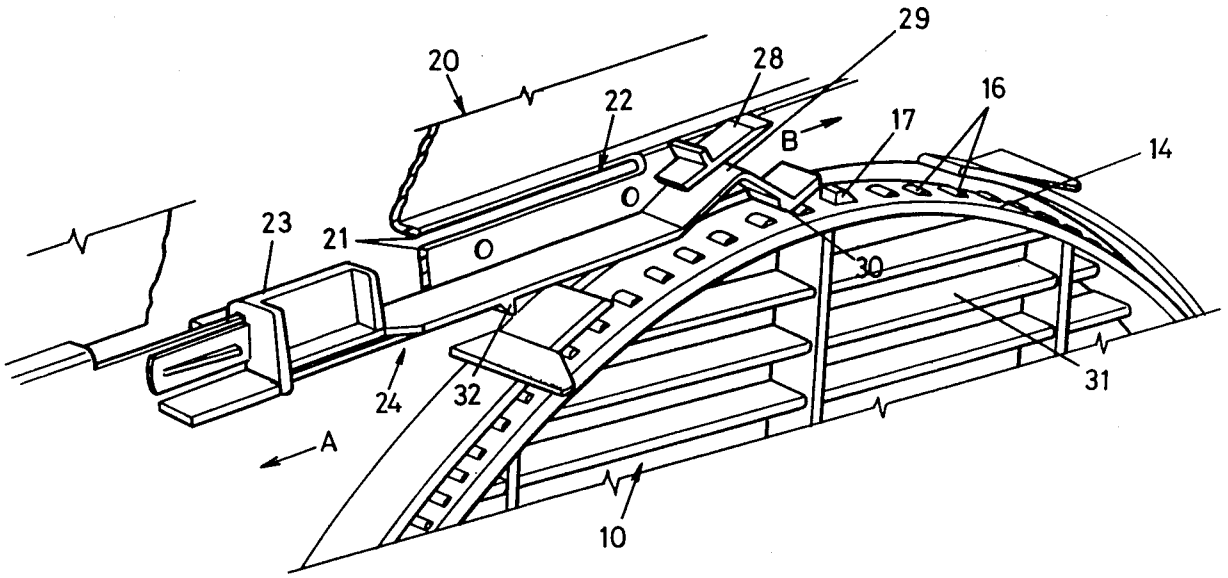
FIG. 4 is a fragmentary perspective view which illustrates the operation of the control means.

In this embodiment, there is provided control means for arresting rotation of an air deflector grille 10 which is carried for rotation on a central spindle 11 in a frame 12 of an air cooler, and wherein the air deflector grille 10 has a plurality of air deflector blades 13 which are parallel to one another but differently inclined as shown in FIG. 1 and have the ends in an annular ring 14. The control means comprise a plurality of minor projections 16 and one major projection 17 (FIG. 4), each minor projection 16 having a curved outer surface and being much lower in height than the major projection 17.

The frame 12 comprises a front panel 20, the front panel 20 having surfaces 21 which define between them in the elongate slot 22. The surfaces on each side of the slot 22 are guide surfaces and these are engaged by a finger operable channelled portion 23 of a slider bar 24, and guide this slider bar 24 for movement which is substantially tangential to the annular ring 14 of the grille 10. The slider bar 24 comprises an elongate finger 25 which projects from one end of the channel portion 23, and the material of the slider bar 24 is a resilient plastics material which is deflectable, the elongate finger 25 being readily deformable. To achieve such deformation when required, the front panel 20 is provided with a short ramp 28, and the slider bar 24 comprises a ramp follower heel 29 which slidingly engages the ramp 28 when the slider bar is moved in a first direction of arrow 'A' only, and when this occurs, the end of the elongate finger 25 deflects downwardly so that an abutment surface 30 thereof is urged into engagement with the outer periphery of the annular ring 14, and thereby will engage any one of the projections 16 or the projection 17.

If however the slider bar is moved in a second direction 'B' a downwardly directed tooth 32 of the slider bar will move into the path of travel of the major projection 17 without any deflection of the slider bar. It maybe noted that the deflection of the slider bar is required only to limit the size of the slider bar, or, if the grille 10 is of relatively large diameter. In many instances this is not required.

When the tooth 32 arrests rotation by engagement against the major projection 17, the blades 13 of the grille 10 are parallel to the fixed blades 33 of the front panel 20. These thereby match the front panel 20 and a good appearance is maintained. If however one of the minor projections 16 is engaged by the abutment surface 30, the deflector is arrested in its rotation, and this arrest can be at any one of a plurality of selected points so that the air discharged from the cooler may for example be directed onto a person. At any intermediate location, the slider bar does not interfere with rotation of grille 10 and this rotation is free, as is the usual case.

In consideration of the above embodiment will indicate that the invention is very simple but nevertheless results in a useful and inexpensive control for arresting the rotation of a rotary grille 10.

I claim:

1. Control means for arresting rotation of an air deflector grille which is carried for rotation in a frame, wherein said air deflector grille has a plurality of air deflector blades carried at their ends in an annular ring, comprising a plurality of minor spaced projections extending outwardly a relatively small distance from the annular ring, and at least one major projection extending outwardly a relatively large distance from the annular ring, guide means on the frame, a slider bar guided for movement by the guide means, two abutment surfaces on the slider bar, the first of those abutment surfaces being engageable with any said projection upon movement of the slider bar in a first direction, and the second abutment surface being engageable only with the major projection upon movement of the slider bar in a second direction, either said engagement inhibiting said rotation.

2. Control means according to claim 1 wherein said frame comprises a ramp, and said slider bar comprises a ramp follower heel which slidably engages the ramp when the slider bar is moved in a first direction, said slider bar being of resilient material and portion thereof being deflectable by said slidable engagement of its heel with the ramp into the path of travel of said projections upon said movement in a first direction.

3. Control means according to claim 1 wherein said slider bar comprises a tooth outstanding from a surface of the slider bar, said second abutment surface being a surface of said tooth and movable into the path of major projection only upon movement of the slider bar in said second direction.

4. Control means according to claim 2 wherein said frame has spaced surfaces which define between them an elongate slot, and said slider bar slidably engages those slot surfaces, and comprises a finger operable channel portion at one end thereof, surfaces of which slidably engage surfaces of the frame, said deflectable portion of the slider bar being an elongate finger which projects from one end of said channel portion.

* * * * *